US005308963A

United States Patent [19]

Baitz

[11] Patent Number: 5,308,963

[45] Date of Patent: May 3, 1994

[54] GOODS SCANNING DEVICE FOR SALES OUTLETS

[75] Inventor: Günter Baitz, Berlin, Fed. Rep. of Germany

[73] Assignee: Siemens Nixdorf Informationssysteme Aktiengesellschaft, Fed. Rep. of Germany

[21] Appl. No.: 30,378

[22] PCT Filed: Oct. 10, 1991

[86] PCT No.: PCT/EP91/01931

§ 371 Date: Apr. 1, 1993

§ 102(e) Date: Apr. 1, 1993

[87] PCT Pub. No.: WO92/06628

PCT Pub. Date: Apr. 30, 1992

[30] Foreign Application Priority Data

Oct. 10, 1990 [DE] Fed. Rep. of Germany ..... 4032170

[51] Int. Cl.[5] ..... G06K 7/10

[52] U.S. Cl. ..... 235/462; 235/470; 248/122

[58] Field of Search ..... 235/439, 440, 462, 470, 235/484, 383, 385; 248/122, 125; 186/61

[56] References Cited

U.S. PATENT DOCUMENTS 4,968,883 11/1990 Leyshon et al. ..... 250/239
5,140,141 8/1992 Inagaki et al. ..... 235/462

FOREIGN PATENT DOCUMENTS 0351150 1/1990 European Pat. Off. .
0445422 9/1991 European Pat. Off. .
3137572 3/1983 Fed. Rep. of Germany .
61-128382 6/1986 Japan ..... 235/462

*Primary Examiner*—Donald Hajec
*Assistant Examiner*—Adrian Young
*Attorney, Agent, or Firm*—Hill, Steadman & Simpson

[57] ABSTRACT

A goods scanning device in which the goods scanning window fitted in a housing is arranged upright beside the goods conveying surface has already been proposed. Furthermore, goods scanning devices in which the goods scanning window is arranged in the goods conveying surface and level with or above the latter are known from practice. In the case of the novel goods scanning device, the goods scanning performed by the goods scanning window is to be facilitated.

For this purpose, the housing (12) is adjustable in such a way that the goods scanning window (13) is located as desired in a horizontal or vertical position (B, C, D). In a preferred embodiment, the goods scanning window (13) is arranged in the horizontal position (B, D) as desired in the region of the goods conveying surface (11) and level with the latter or above the goods conveying surface (11) and at a distance therefrom.

The goods scanning device is particularly suitable for registering heavy and/or bulky articles.

12 Claims, 2 Drawing Sheets

GOODS SCANNING DEVICE FOR SALES OUTLETS

BACKGROUND OF THE INVENTION

The invention relates to a goods scanning device for sales.

Such a good scanning device is known from German reference DE 31 37 572 A1. In the case of the known subject, a scanning device for reading goods markings is arranged in a housing. The housing can be adjusted into various positions along a circular path. In a position below the goods conveying surface, the scanning is performed through a fixedly arranged goods scanning window. In this position, the distance between the goods marking on the goods and the scanning device is constant, so that an exact reading-in of the goods marking can be performed. When adjusting into the vertical position and into the position above the goods conveying surface, the goods scanning window is not adjusted at the same time. This means that, in the vertical position, in which the housing is arranged to the side of the goods, the distance between the scanning device and the goods marking can vary. As a result, the reading-in of the goods marking is impaired or even impossible.

A goods scanning device in which the goods scanning window is vertically adjustable and arranged upright in each operating position has already been proposed. Furthermore, goods scanning devices in which the goods scanning window is provided in a horizontal goods conveying surface and level with or above the latter are known from practice. For their registration, all the goods, products or articles must be deposited on the goods conveying surface and taken past the goods scanning window, in order that the goods marking can be scanned by a scanning device arranged behind the goods scanning window. Problems in registration may occur in particular in the case of bulky and/or heavy articles, since these not only have to be lifted by the user, that is the operator or the customer, onto the goods conveying surface, but also have to be turned in such a way that the goods marking provided on the goods is facing the goods scanning window. Depending on the weight of the article, such an operation may require great exertion, so that in some circumstances certain groups of users are not able at all to register the articles concerned themselves.

SUMMARY OF THE INVENTION

The invention is based on the object of providing a goods scanning device of the type specified at the beginning which allows an exact reading-in of the goods marking in all positions of the housing.

This object is achieved according to the invention by a goods scanning device having a substantially horizontal goods conveying surface, forming a conveying path, having an adjustable housing, into which a scanning device for scanning a goods marking can be fitted. The housing is located as desired in a horizontal position, parallel to the goods conveying surface, in which position it is arranged above the goods conveying surface and at a distance therefrom or in the region of the goods conveying surface, or in a position vertical to the goods conveying surface. The goods scanning device also has a goods scanning window which extends parallel to the goods conveying direction and through which the goods marking can be scanned. The goods scanning window is part of the housing and can be adjusted together with the housing. In the vertical position, the goods scanning window is arranged upright beside the goods conveying surface. In the horizontal position, the goods scanning window is arranged in the region of the goods conveying surface level with the latter.

It is consequently possible to arrange the housing, and consequently the goods scanning window, as desired both in a horizontal position and in a vertical position, so that turning of the goods to be registered has to be carried out less frequently. Consequently, the goods scanning window can be adapted at least partially to the location of the goods marking.

In particular in large supermarkets, there is a great change, varying according to the time of day and time of year, between large and small articles at the cash desk. Until now, these articles could only be paid for at separate cash registers. The invention makes it possible to pay for both large and small articles at one and the same cash register.

In the vertical position, the goods scanning window is arranged upright beside the conveying surface. In the case of goods of the abovementioned type, the goods markings are frequently on a side surface, so that for scanning their goods marking the goods concerned can simply be deposited on the goods conveying surface, without the need for laborious turning of the goods about a horizontal axis as required for cases where the goods scanning window is provided in the goods conveying surface. In the case of the arrangement of the goods scanning window in the vertical position, it may be necessary, depending on where the goods marking is provided, to turn the goods about a vertical axis in order that the goods marking is turned toward the goods scanning window. However, turning of the articles concerned about a vertical axis can generally be carried out more easily than turning about a horizontal axis. If using a goods scanning device having an operating area with operating elements arranged to the side of the conveying surface transversely to the goods conveying direction, the goods scanning window may preferably be arranged on the side of the operating area near to the goods conveying surface. In this case, the goods scanning window may be provided in securing means which are present in any case for the operating area and therefore assume a type of dual function receiving both the operating area and the goods scanning window.

In the horizontal position, the goods scanning window is arranged as desired in the region of the goods conveying surface and level with the latter or above the goods conveying surface and at a distance therefrom. Consequently, it is possible to register articles on which the goods marking is provided on the upper side or underside or on a side wall without changing their position on the goods conveying surface. For registering the goods concerned, all that is required is to bring the housing, with the goods scanning window located in it, into the position which faces the goods marking. Depending on the weight of the goods to be registered, adjusting the housing generally involves considerably less exertion, however, than turning the goods into the position to be registered.

Furthermore, it is favorable to arrange the housing in the same plane transversely to the goods conveying direction in all the positions of the goods scanning window. As a result, the goods conveying surface can be of a relatively short design, so that normally, for adjusting the housing, a user can stay in the position assumed for placing the goods on the goods conveying surface.

In the case of a further development of the goods scanning device, the housing is guided displaceably with the aid of an L-shaped sliding guide and guide bolts engaging therein, the sliding guide preferably being provided partially on an approximately vertical support, partially on a goods scanning table connected to the latter and forming the goods conveying surface. This provides a simple possible way of holding the housing securely both in a horizontal position and in a vertical position and of ensuring transfer from the one position into the other position and vice versa. There is advantageously provided in the support and goods scanning table an L-shaped recess, open toward the goods conveying surface, for at least partially receiving the housing, it being possible for the sliding guide to be arranged in side walls of the recess running transversely to the conveying direction. Due to the at least partial arrangement of the housing in a recess the goods scanning window is also protected during operation of the goods scanning device, so that damage to the window can occur less easily. The sliding guide may be worked into the support and the goods scanning table and therefore be connected integrally therewith. It is also possible, however, to design the sliding guide as a profile and to fasten it to side walls of the recess running transversely to the goods conveying direction. This embodiment has the advantage that, if need be, the sliding guide can be easily repaired and exchanged. In the case of a further development, the sliding guide has a horizontal section and a vertical section, the horizontal section being arranged in the region of the recess formed in the goods scanning table and the vertical section being arranged in the region of the recess formed in the support. The sliding guide is consequently provided simply on parts of the goods scanning device which are normally present in any case and are already in a horizontal or vertical position.

The sliding guide is preferably a guide groove which extends along the horizontal and vertical section and, in the case of a further development, has, near to its upper end, a shoulder which subdivides the guide groove into a part situated below and a part situated above, the latter having a smaller groove depth than the former. The guide bolts are preferably provided as protruding laterally from the housing, near to its ends, the guide bolts arranged near to the one end, guided exclusively in the part of greater groove depth, having a length corresponding approximately to this groove depth, and the guide bolts arranged near to the other end having a length corresponding approximately to the smaller groove depth. This makes it possible to guide one end of the housing constantly in the guide groove, but on the other hand to guide another end in the guide groove only in certain window positions. This give can give rise to advantages in particular to the effect that the guide bolts of greater length can be supported on the shoulder of the guide groove, so that the housing is held, at least at one end, in particular in its horizontal position at a distance from the goods conveying surface.

The guide groove extending in the vertical section is preferably open at the top, so that the guide bolts of the length corresponding to the smaller groove depth, located at the upper end of the housing in the vertical position of the goods scanning window, can disengage from the guide groove when the housing is pushed up. This permits a swivelling movement of the housing about the axis of the guide bolts of greater length out of the vertical position into the horizontal position of the goods scanning window. Above the part of the recess formed in the goods scanning table there is preferably provided a rest for the housing arranged above the part concerned of the recess and at a distance therefrom, which rest at least partially shortens the distance between mutually opposite sliding guides, the upper edge of the rest being arranged below a horizontal plane intersecting the upper end of the shoulder provided in the guide groove. As a result, the housing is held securely in a position which allows a position of the goods scanning window at a distance from the goods scanning surface and parallel thereto. The housing is consequently supported securely on the one hand by its guide bolts on the shoulder of the guide groove, on the other hand on the rest, so that unintentional adjusting of the housing is prevented to a great extent.

In the case of a further development of the goods scanning device, the vertical distance between the upper edge of the rest and the upper end of the shoulder corresponds to the vertical distance between the wall of the housing receiving the goods scanning window and the outer end of the guide bolts, remote from the wall. It is ensured by this measure that, in the position at a distance from the goods conveying surface, the housing, and consequently the goods scanning window, is aligned approximately horizontally and parallel to the goods conveying surface.

It is favorable furthermore to provide in the region of the part of the recess formed in the goods scanning table a sprung base which is prestressed into a position level with the goods conveying surface and can be arrested in this position. This on the one hand provides a level goods conveying surface, so that the goods to be registered can be readily pushed from one side of the goods conveying surface onto the other. On the other hand, adjusting of the goods scanning window located in the vertical position into the horizontal position level with the goods conveying surface is prevented, so that this position can only be adopted when the sprung base is pressed downward against its prestressing. Consequently, unintentional displacing of the housing into the position of the goods scanning window level with the goods conveying surface is ruled out to a great extent.

It is favorable furthermore to increase the power of a scanning device arranged behind the goods scanning window when the goods scanning window is located in its horizontal position above the goods conveying surface and at a distance therefrom. Consequently, registration of goods is also possible in the described position of the goods scanning window in which there is a relatively great distance between the goods scanning window and the goods marking on the goods. On the other hand, the increase in the power of the scanner, generally a laser, is not dangerous in this position, since it emits downward and thus cannot shine into people's eyes. Advantageously, the sliding guide of the housing, preferably together with the support, is vertically adjustable independently of the goods scanning table or with the latter. This makes it possible to adapt the goods conveying surface exactly to the level of the articles to be registered which are concerned, so that the latter can simply be pushed onto the goods conveying surface. The height of the goods conveying surface can consequently be matched to the height of the conveying means. Adjusting of the goods scanning table, and consequently of the goods conveying surface, can consequently have automatically as a consequence a corresponding adjusting of the goods scanning window. Thus, the user does not have to consider whether the goods scanning window is adjusted at a height suitable for registering the goods if the height of the goods scanning table is altered. Consequently, it is readily possible for a user to unload in stages a cart loaded in several layers and, when so doing, to adjust the goods conveying surface always to the optimum height, i.e. adapted to the respective layer. It may, however, also be possible to adjust the sliding guide, and consequently the goods scanning window, vertically in relation to the goods scanning table. It may namely be required, in particular in the case of heavy products of large volume, to adjust the goods scanning table into a position near to the floor and the goods scanning window into a position far from the floor, because the goods marking to be scanned is provided approximately half-way up the goods or near to the upper edge thereof. With this embodiment of the goods scanning device, therefore, goods markings provided at remote points can also be machine-scanned, so that there is no need for tiresome, time-consuming and error-affected manual input of the data, for example on an input keyboard. All the articles can consequently be scanned with the user in an upright, ergonomically correct position.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENT

Figure 1:
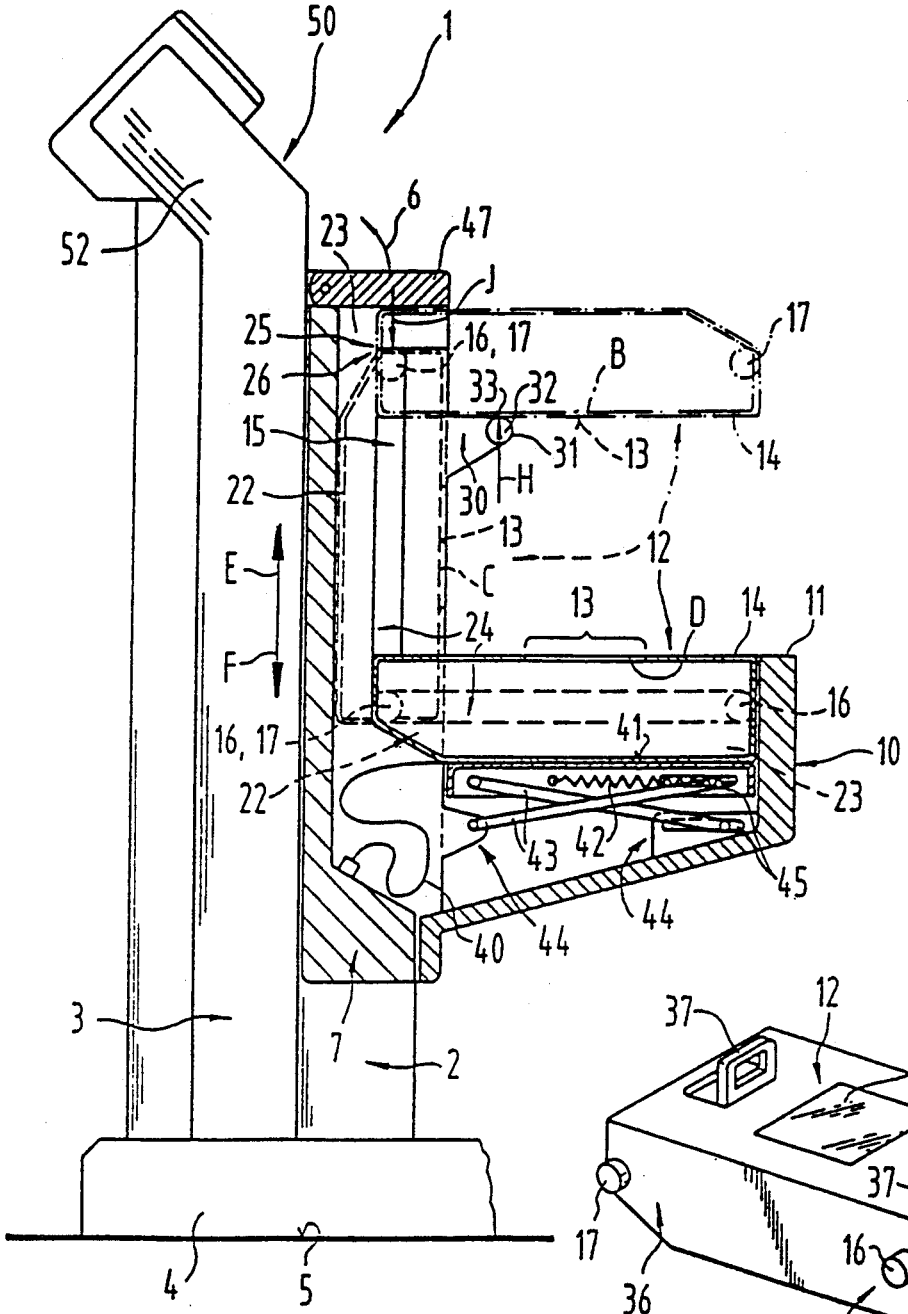
FIG. 1 shows a diagrammatic, partially sectioned side view of a goods scanning device with a housing, receiving a goods scanning window, in various positions.

In FIG. 1 a goods scanning device 1 for sales outlets is shown diagrammatically in a partially sectioned representation. The goods scanning device 1 has a front column 2 (in FIG. 1 facing to the right) and a rear column 3 (in FIG. 1 facing to the left), which are connected to each other and the lower ends of which are connected firmly to a floor 5 by means of a pedestal 4, for example with the aid of fastening screws (not shown). According to FIG. 3, the front column 2 has flattened-off corners 6.

Figure 3:
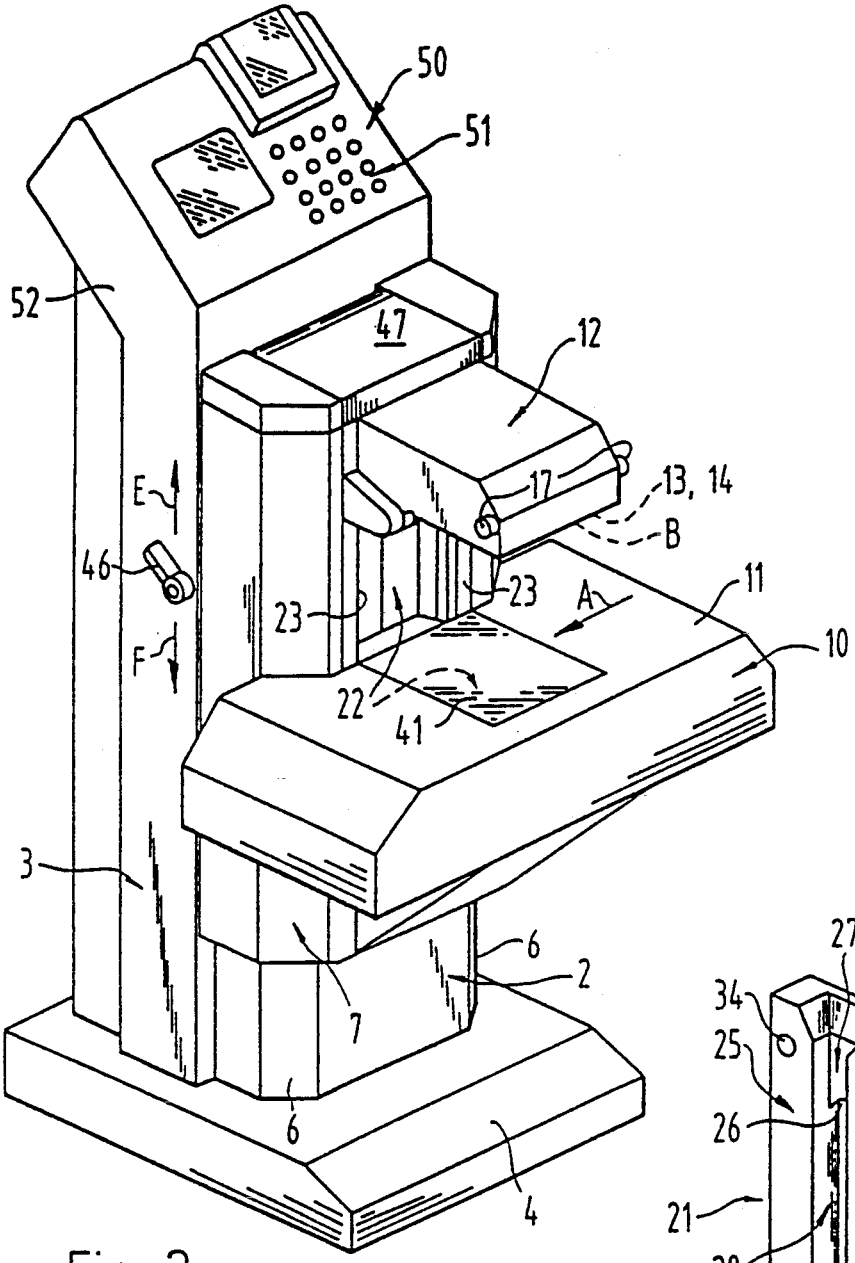
FIG. 3 shows a diagrammatic, perspective view of the goods scanning device.

According to FIGS. 1 and 3, a support 7 is guided vertically displaceably in a way not represented in any more detail on the front column 2 (see arrows E, F). It is, however, also possible to design the support in the form of a column and connect it directly to the pedestal and the floor. Fastened on the support 7 is a goods scanning table 10, which has a horizontal goods conveying surface 11, forming a conveying path, as upper side. Also arranged on the support 7 is an adjustable housing 12, in which there is fitted a goods scanning window 13 which faces the region above the goods conveying surface 11, extends parallel to the goods conveying direction (see arrow A in FIG. 3) and, due to the adjustable housing 12, is located as desired in a horizontal or vertical position B, C, D. In the vertical position C (dashed-line representation), the goods scanning window 13 is arranged upright beside the goods conveying surface 11, whereas in the horizontal position it is arranged as desired in the region of the goods conveying surface 11 (see position D in solid lines) and level with the latter or above the goods conveying surface 11 (see position B in dot-dashed lines) ana at a distance therefrom. Since the goods scanning window 11 is arranged in the housing 12 in such a way that it is level with a wall 14 of the housing, in order to arrange the goods scanning window in the desired position B, C or D, the housing 12 is adjusted in such a way that at least the wall 14 of the housing 12 is in the same position as the goods scanning window 13.

According to FIGS. 1 and 3, in all the positions B, C, D of the goods scanning window 13, the housing 12 is arranged in the same plane transversely to the goods conveying direction (see arrow A) and is guided displaceably with the aid of an L-shaped sliding guide 15 and guide bolts 16, 17 engaging therein. The sliding guide 15 is shown in more detail in FIGS. 1 and 4 and has a horizontal section 20 and a vertical section 21, the former being provided on the goods scanning table 10, the latter on the support 7, as is explained in more detail below.

Both in the support 7 and in the goods scanning table 10 there is provided an L-shaped recess 22 which is open toward the goods conveying surface 11 and is dimensioned in such a way that the housing 12 can be received completely in it. Accordingly, the width of the recess is slightly greater than the width of the housing and the depth of the recess is slightly greater than the depth or height of the housing. The length of the horizontal section 20 corresponds approximately to the length of the housing 12, whereas the length of the vertical section 21 is determined by the length of the housing 12 and the amount of vertical displacement of the housing 12 in relation to the goods conveying surface. For holding the housing, the sliding guide 15 is arranged in side walls of the recess 22 running transversely to the goods conveying direction (see arrow A). As FIGS. 1 and 3 reveal in particular, the horizontal section 20 is thus arranged in the region of the recess 22 formed in the goods scanning table 10 and the vertical section 21 is arranged in the region of the recess formed in the support 7.

According to FIGS. 1 and 4, the sliding guide 15 is a guide groove 24 which extends along the horizontal and vertical section 20, 21 and has, near to its upper end 25, a shoulder 26 which subdivides the guide groove 24 into a part 27 situated above and a part 28 situated below, the former (27) having a smaller groove depth than the latter (28).

Figure 4:
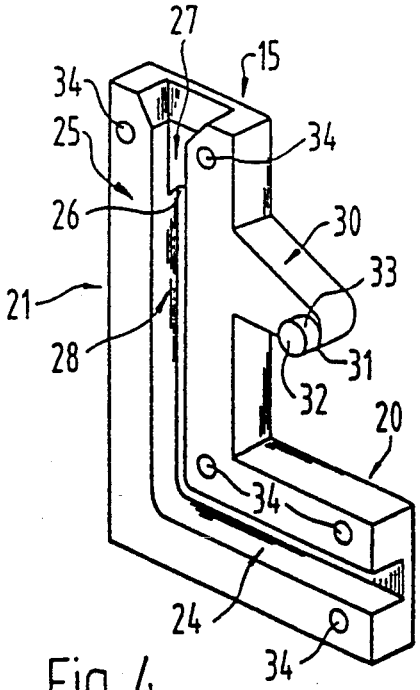
FIG. 4 shows a diagrammatic, perspective view of a sliding guide receiving the housing.

According to FIG. 4, the part 27 of the guide groove 24 is open at the top and conically widened. Provided in the region above the horizontal section 20 is a supporting device 30 which is integrally connected to the vertical section 21 of the sliding guide 15 and serves as a rest 31 for the housing 12 arranged above the part of the recess 22 formed in the goods scanning table and at a distance therefrom. The rest 31 laterally adjoins the supporting device 30 in such a way that the distance in the installed state between mutually opposite sliding guides 15 is partially shortened. The shortest distance between end faces 32 of the rests 31 is less than the width of the housing 12. The rest 31 is attached to the vertical section 21 of the sliding guide 15 in such a way that the upper edge 33 of the rest 31 is arranged below a horizontal plane intersecting the upper end of the shoulder 26 provided in the guide groove 24. As shown in FIG. 4, the shoulder 26 in the guide groove 24 is approximately semi-cylindrically designed; it may, however, also be rectangularly shaped. The sliding guide 15 is fastened detachably to the side walls 23 of the recess 22 with the aid of fastening means (not shown in any more detail), such as for example screws, fitted in through-holes 34. It is also possible, however, to work the guide groove 24 directly into the side wall of the recess.

The guide bolts 16, 17 are provided as protruding laterally from the housing 12, near to its ends 35, 36, the guide bolts 16 arranged near to the one end 35 being guided exclusively in the part 28 of greater groove depth and having a length corresponding to this groove depth. The guide bolts 17 arranged near to the other end 36 have a length corresponding approximately to the smaller groove depth. It follows from this that the guide bolts 17 can disengage from the guide groove 24 when the housing 12 is pushed up out of the position C into the position B of the goods scanning window 13, since the guide bolts 17 can be taken past the shoulder 26. The shoulder 26 thus does not represent a limitation of the displacing path for the guide bolts 17.

Figure 2:
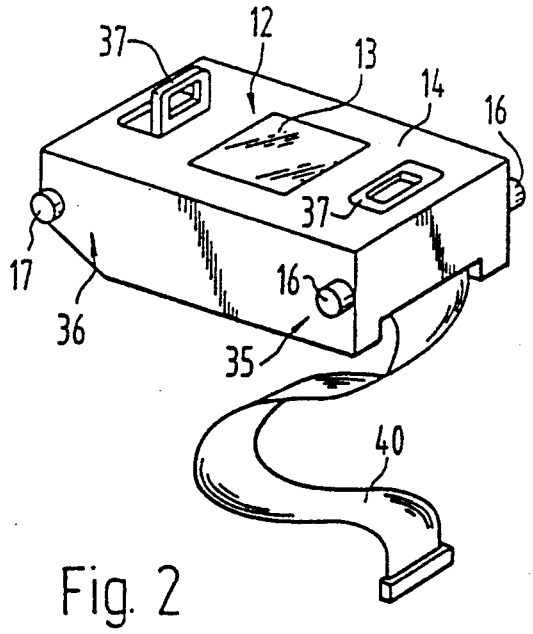
FIG. 2 shows a diagrammatic, perspective view of the housing according to FIG. 1.

Let into the wall 14 of the housing 12 on each of mutually opposite sides of the goods scanning window 13 is a hinged grip 37, which is prestressed in the direction of its position level with the wall 14 (see FIG. 2). With the aid of these grips 37, the housing can be easily transferred out of the one position into the other position of the goods scanning window. In each position of the goods scanning window 13, the end 35 of the housing 12 remains within the recess 22 and is connected to a cable 40 in order to connect the scanning device (not shown), fitted behind the goods scanning window 13, to an electrical or electronic control unit (not shown).

The guide bolts 16, 17 are attached laterally to the housing 12 in such a way that the vertical distance between the upper edge 33 of the rest 31 and the upper end of the shoulder 26 corresponds to the vertical distance between the wall 14 and the outer end of the guide bolts, remote from the wall. As FIGS. 1 and 2 reveal in detail, all the guide bolts 16 and 17 are at the same distance away from the wall 14 of the housing 12.

According to FIGS. 1 and 3, in the region of the part of the recess 22 formed in the goods scanning table 10 there is provided a sprung base 41 which is prestressed into a position level with the goods conveying surface 11 with the aid of a stressing device designed as a spring 42 and can be arrested in this position in a way not shown. The sprung base 41 is fastened by means of scissors-forming, crossing bars 43 to a holding device 44, connected to the goods scanning table 10, in such a way that the bars 43 can move in relation to each other and the sprung base is adjustable only parallel to itself. For this purpose, the ends of each bar are swivel-mounted, one end being additionally displaceable in a slot 45. Such a slot 45 is provided both on the holding device 44 and on the sprung base 41. The sprung base 41 consequently closes the part of the recess 22 formed in the goods scanning table 10 when the goods scanning window 13 is located with the housing 12 in its position B or C. In these cases, the upper side of the sprung base 41 is level with the goods conveying surface ii. When the goods scanning window is located in the position D, the wall 14 is level with the goods conveying surface 11, so that there is a level goods conveying surface 11 irrespective of the position of the goods scanning window.

When the goods scanning window 13 is located in its horizontal position B above the goods conveying surface 11 and at a distance therefrom, the power of a scanning device (not shown) arranged behind the goods scanning window 13 is increased, in order to be able to scan properly goods markings which are at a relatively great distance from the goods scanning window. It is possible furthermore to provide the scanning device with an automatic focusing device.

In the case of a further development of the goods scanning device, the sliding guide 15 of the housing 12 is vertically adjustable together with the support 7 and the goods scanning table 10, the support 7 being displaceable up and down on the front column 2 (see arrows E, F in FIGS. 1 and 3). For fixing the height of the support 7, there is provided laterally on the rear column 3 a hinged lever 46, with the aid of which the support 7 is vertically adjustable in a way not shown in any more detail. According to FIG. 1, however, the lever 46 may also be omitted if the height adjustment of the support can be carried out in some other way, for example by means of foot switches (not shown) or an electromotive drive.

Provided at the upper end of the support 7 is a flap 47 which closes the part of the recess 22 provided in the support and is hinge-mounted on the support. When the housing is adjusted out of the position B into the position C of the goods scanning window, the housing 12 is initially swivelled upward about the axis of its guide bolts 16, the flap 47 moving in the direction of the arrow G.

An operating area 50 with operating elements 51 is arranged in an attachment 52 on the upper side of the rear column 3 above the goods conveying surface 11 and transversely to the goods conveying direction. Along with the operating elements 51, the attachment 52 may also receive an output opening and a visual display unit which has a screen and is connected to the attachment 52 directly or by means of a supporting device (not shown). The operating elements may be designed as an input keyboard and/or control keyboard. The output opening may, for example, be an output tray for a receipt or sales slip. In the attachment 52 there may also be provided a document printer, which prints on a receipt the data or information on the goods registered with the aid of the scanning device.

The grips 37 provided on the housing 12 may also be designed differently, for example as bars let into the housing. Furthermore, it is possible to connect the supporting device 30 to the support 7, for example, instead of to the sliding guide 15. The supporting device may, however, also be attached to some other element of the goods scanning device. The rest 31 preferably acts on the housing (see arrow H) in such a way that the bearing point is at a smaller distance from the guide bolts 16 than the center of gravity of the housing 12. In this case, on account of the torques occurring around the bearing point, the housing is held securely in its position shown in FIGS. 1 and 3 (position B of the goods scanning window). The counteracting force (see arrow I in FIG. 1) is absorbed by the guide bolt 16 held on the shoulder 26.

The operation of the goods scanning device is explained below by way of example.

The user, for example a customer in a sales outlet, travels with his cart loaded with goods up to the goods scanning table 10 of the goods scanning device 1, for example from the right, and subsequently adjusts the height of the goods conveying surface 11, for example by actuating the lever 46, preferably to the height of the individual goods on the cart in such a way that, wherever possible, bulky and/or heavy goods do not have to be lifted onto the goods conveying surface 11 but can be pushed onto it. The goods are then located on the goods conveying surface 11 and are taken along the goods conveying direction (see arrow A) past the goods scanning window 13 in such a way that the goods marking (bar-code marking) is scanned by the scanning device located behind the window and the information on said marking can be displayed and/or transferred to a data processing system (not shown).

For taking the goods marking past the goods scanning window, the housing receiving the goods scanning window is adjusted in such a way that the registration can be performed as far as possible without turning around or turning over the goods located on the goods scanning table. If the goods marking is provided on the upper side of the goods, the goods can be displaced on the goods scanning table 10 in the direction of the arrow A in such a way that the goods marking is taken past below the goods scanning window 13 located in the position B (see FIG. 3) . It is clear that in this case the height of the goods must be less than the distance of the wall 14 of the housing 12 from the goods conveying surface 11. In the case of an illustrative embodiment not shown in any more detail, it may be possible to adjust the goods scanning table 10 in relation to the goods scanning window located in the position B in such a way that the distance between the wall 14 of the housing 12 and the goods conveying surface 11 is increased or reduced.

If, on the other hand, the goods marking is located on a side surface of the goods to be registered (preferably facing away from the user) , before the goods are registered the goods scanning window is transferred together with the housing out of the position B into the position C by the housing being grasped at the grip 37 arranged near to the short guide bolts 17 and swivelled upward about the axes of the long guide bolts 16 until the axes of the guide bolts 16, 17 are arranged vertically one above the other. In this swivelling movement, the flap 47 is displaced in the direction of the arrow G. Subsequently, the housing 12 is displaced downward until the position B of the goods scanning window 13 is reached. In this position, all the guide bolts 16, 17 are in engagement with the guide groove 24, the guide bolts 16 are located in the transitional region between the horizontal section 20 and vertical section 21 of the sliding guide 15. In the position B of the goods scanning window, the flap 47 has again assumed its position shown in FIGS. 1 and 3. The goods marking located on the side surface of the goods is subsequently taken past the upright goods scanning window.

It is possible furthermore for the goods marking of the goods deposited on the goods conveying surface 11 to be located on the underside of the goods. In this case, before the goods are registered, the goods scanning window is transferred out of its vertical position C into the horizontal position D by the housing 12 being drawn with the aid of the grip 37, provided near to the guide bolts 16, to the right in FIG. 1, i.e. toward the user. The sprung base 41 is thereby pressed downward in FIG. 1 against the force of the spring 42. As a result, the guide bolts 16 are moved along the horizontal section 20 and the guide bolts 17 are moved along the vertical section 21 of the sliding guide 15. In the position D, all the guide bolts are in a common horizontal plane.

When transferring the goods scanning window out of the horizontal position D into the vertical position B, the sprung base 41 slides automatically upward and assumes its position level with the goods conveying surface 11. In the case of the goods scanning window in the position D as well, to register the goods they are simply pushed along the goods conveying direction (see arrow A) over the goods conveying surface 11.

The goods taken over the goods conveying surface 11 past the goods scanning window 13 may be deposited, for example, in a goods basket (not shown) put in place to the left of the goods scanning device 1. The goods scanning device may be designed in such a way that the customer subsequently pays the amount printed on a receipt and displayed by a visual display unit either by means of a customer or credit card via a card reader (not shown) or using money input and output openings, which may be arranged on the operating area 50. It is, of course, also possible to pay the invoice amount at a cash point set up separately. In addition, the goods scanning device may be equipped in such a way that, if problems occur with the goods scanning, the customer can call on a supervisor, for example via a control keyboard. Consequently, the scanning of goods, in particular bulky and/or heavy articles, is simplified considerably.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A goods scanning device for sales outlets, comprising: a substantially horizontal goods conveying surface, forming a conveying path; an adjustable housing, into which a scanning device for scanning a goods marking is fitted, the housing being locatable in at least first and second horizontal positions parallel to the goods conveying surface, in said first horizontal position the housing being arranged above the goods conveying surface and at a distance therefrom, in said second horizontal position the housing being arranged in a region of the goods conveying surface, or in a third position vertical to the goods conveying surface; the housing having a goods scanning window which extends parallel to the goods conveying direction and through which the goods marking is scannable; the goods scanning window being part of the housing and adjusted together with the housing; in the vertical third position of the housing, the goods scanning window being vertically arranged beside the goods conveying surface; and in the second horizontal position, the goods scanning window being arranged in the region of the goods conveying surface level with the goods conveying surface.

2. The goods scanning device as claimed in claim 1, wherein the goods conveying surface is a goods scanning table which has a recess in which is arranged a sprung base which is prestressed into a position level with the tools conveying surface and which is fixable in this position.

3. The goods scanning device as claimed in claim 1, wherein the housing is guided displaceably with the aid of an L-shaped sliding guide and has a plurality of guide bolts engaging with the guide.

4. The goods scanning device as claimed in claim 3, wherein the sliding guide is provided partially on an approximately vertical support, partially on the goods scanning table connected to the vertical support and forming the goods conveying surface.

5. The goods scanning device as claimed in claim 4, wherein the support and goods scanning table together have an L-shaped recess, open toward the goods conveying surface, for at least partially receiving the housing, wherein the sliding guide is arranged in side walls of the recess running transversely to the goods conveying direction and is formed by a guide groove, and wherein the sliding guide has a horizontal section and a vertical section, the horizontal section being arranged in a region of the recess in the goods scanning table and the vertical section being arranged in a region of the recess in the support.

6. The goods scanning device as claimed in claim 5, wherein the guide groove has, near to an upper end thereto, a shoulder which subdivides the guide groove into an upper part situated above the shoulder and a lower part situated below, the upper part having a smaller groove depth than the lower part, and wherein the plurality of guide bolts are provided as protruding laterally from the housing, near respective ends of the hosing, guide bolts of the plurality of guide bolts arranged near one end of the housing, guided exclusively in the lower part of greater groove depth, having a length corresponding approximately to this groove depth, and guide bolts of the housing arranged near the other end of the housing having a length corresponding approximately to the smaller groove depth.

7. The goods scanning device as claimed in claim 6, wherein the upper part of the guide groove extending in the vertical section is open at a top thereof, so that the guide bolts of the length corresponding to the smaller groove depth, located at an upper end of the housing in the vertical position of the goods scanning window, can disengage from the guide groove when the housing is pushed up.

8. The tools scanning device as claimed in claim 6, wherein above the region of the recess formed in the goods scanning table is provided a rest for the housing, the rest being above the area of the recess formed in the goods scanning table and at a distance therefrom, which rest at least partially shortens the distance between mutually opposite sliding guides, an upper edge of the rest being arranged below a horizontal plane intersecting an upper end of the shoulder provided in the guide groove.

9. The goods scanning device as claimed in claim 8, wherein a vertical distance between the upper edge of the rest and the upper end of the shoulder corresponds to a vertical distance between a wall of the housing receiving the goods scanning window and an outer end of the guide bolts, remote from the wall.

10. The goods scanning device as claimed in claim 1, wherein the goods scanning device further comprises a scanning device arranged behind the goods scanning window and wherein a power level of the scanning device arranged behind the goods scanning window is increased when the goods scanning window is located in the first horizontal position above the goods conveying surface and at a distance therefrom.

11. The goods scanning device as claimed in claim 1, wherein the sliding guide for the housing, is vertically adjustable with or without the goods scanning table.

12. The goods scanning device as claimed in claim 1, wherein the goods scanning device further comprises a support for holding the housing and wherein the sliding guide for the housing together with the support is vertically adjustable with or without the goods scanning table.

* * * * *